US011072520B2

(12) United States Patent
Brun-Kestler et al.

(10) Patent No.: US 11,072,520 B2
(45) Date of Patent: Jul. 27, 2021

(54) SYSTEM, DEVICE, AND METHOD OF MIXING AND DISPENSING BEVERAGES

(71) Applicants: Mechael Yirmeyahu Brun-Kestler, West Hempstead, NY (US); Greta Pauline Brun-Kestler, West Hempstead, NY (US); Avraham Nachum Brun-Kestler, West Hempstead, NY (US); Mary Kate Sirianni, Lynbrook, NY (US)

(72) Inventors: Mechael Yirmeyahu Brun-Kestler, West Hempstead, NY (US); Greta Pauline Brun-Kestler, West Hempstead, NY (US); Avraham Nachum Brun-Kestler, West Hempstead, NY (US); Mary Kate Sirianni, Lynbrook, NY (US)

( * ) Notice: Subject to any disclaimer, the term of this patent is extended or adjusted under 35 U.S.C. 154(b) by 0 days.

(21) Appl. No.: 16/693,419

(22) Filed: Nov. 25, 2019

(65) Prior Publication Data

US 2020/0095109 A1 Mar. 26, 2020

Related U.S. Application Data

(63) Continuation of application No. 15/965,928, filed on Apr. 29, 2018, now Pat. No. 10,486,954.
(Continued)

(51) Int. Cl.
*B67D 1/00* (2006.01)
*B65D 47/12* (2006.01)
(Continued)

(52) U.S. Cl.
CPC ..... *B67D 1/0034* (2013.01); *B65D 47/12* (2013.01); *B67D 1/0051* (2013.01); *B67D 1/04* (2013.01);
(Continued)

(58) Field of Classification Search
CPC ..... B67D 1/0034; B67D 1/0051; B67D 2001/0812; B67D 2001/0481; B67D 1/07;
(Continued)

(56) References Cited

U.S. PATENT DOCUMENTS 1,897,382 A * 2/1933 Blair ..... A01G 13/0231 47/23.2
3,112,844 A 12/1963 Keller
(Continued)

OTHER PUBLICATIONS

Mocktailsmixer, http://deeplocal.com/mocktailsmixer, 4 pages, Jul. 1, 2019.

*Primary Examiner* — Frederick C Nicolas
(74) *Attorney, Agent, or Firm* — Heidi Brun Associates Ltd.

(57) ABSTRACT

A machine for mixing and dispensing beverages includes a single manifold, a bottle restraining unit and a randomizing beverage activator. The manifold is connectable to a plurality of separate, pre-filled beverage holders of already prepared beverages and provides pre-defined portions of selected beverages to a dispensing outlet. The bottle restraining unit restrains the pre-filled bottles, which are either plastic bottles or glass bottles. The activator dispenses at least two beverages from the set of the beverage holders by randomizing an attribute of a drink. The attribute is chosen from an amount of the beverages and the beverage holders.

9 Claims, 12 Drawing Sheets

Related U.S. Application Data

(60) Provisional application No. 62/491,277, filed on Apr. 28, 2017.

(51) Int. Cl.
*B67D 1/08* (2006.01)
*B67D 1/04* (2006.01)
*B67D 1/07* (2006.01)

(52) U.S. Cl.
CPC ..... *B67D 1/07* (2013.01); *B67D 1/0857* (2013.01); *B67D 1/0878* (2013.01); *B67D 1/0888* (2013.01); *B67D 2001/0098* (2013.01); *B67D 2001/0481* (2013.01); *B67D 2001/0812* (2013.01)

(58) Field of Classification Search
CPC ..... B67D 2001/0098; B67D 1/0878; B67D 1/0888; B67D 1/0857; B67D 1/04; B67D 1/0014; B65D 47/12
See application file for complete search history.

(56) References Cited

U.S. PATENT DOCUMENTS 3,119,485 A 1/1964 Bayers, Jr.
3,777,937 A 12/1973 Buck
3,940,019 A 2/1976 Kross
4,162,028 A 7/1979 Reichenberger
4,433,795 A 2/1984 Maiefski
4,687,120 A * 8/1987 McMillin ..... B67D 1/0021 222/1
4,938,387 A 7/1990 Kervefors
4,941,593 A 7/1990 Hicks
5,494,195 A * 2/1996 Knuettel, II ..... B67D 1/0869 222/132
5,740,946 A * 4/1998 Swier ..... A47J 31/40 222/129.1
5,899,362 A 5/1999 Moran
6,669,053 B1 12/2003 Garson
7,293,675 B1 11/2007 Luhn
7,757,896 B2 7/2010 Carpenter
7,866,508 B2 1/2011 Feldman
8,162,176 B2 4/2012 Rudick
8,584,900 B2 * 11/2013 Metropulos ..... B67D 1/0041 222/129.1
8,739,840 B2 6/2014 Mattos, Jr.
8,746,506 B2 6/2014 Jersey
8,757,222 B2 6/2014 Rudick
8,985,396 B2 3/2015 Jersey
10,046,959 B2 8/2018 Rudick
10,486,954 B2 * 11/2019 Brun-Kestler ..... B67D 1/0878

* cited by examiner

Suppose dispensing time = 10 seconds suppose 3 drinks were selected with a ratio
4:3:1

Step 1:
receive ratios from PNG
[4,3,1]

Step 2:
Select the maximum valve
4

Step 3:
divide the dispensing time into segments based on the maximum valve
10/4 = 2.5

Step 4:
Start dispensing the 3 drinks and at every 2.5 seconds check if a valve needs to be closed off
4 closes at 10 seconds
3 closes at 7.5 seconds
1 closes at 2.5 seconds

SYSTEM, DEVICE, AND METHOD OF MIXING AND DISPENSING BEVERAGES

CROSS REFERENCE TO RELATED APPLICATIONS

This application is a continuation application of U.S. Ser. No. 15/965,928, filed Apr. 29, 2018, which claims priority from U.S. provisional patent application 62/491,277, filed Apr. 28, 2017, both of which are incorporated herein by reference.

FIELD OF THE INVENTION

The present invention relates to a bartending system generally.

BACKGROUND OF THE INVENTION

Bartenders provide soft drinks, mixed drinks and other cocktails to their customers. For a cocktail or other mixed drink, the bartender pours measured amounts of two or more liquors into a glass. There are many different cocktails, all with different ratios of liquors.

U.S. Pat. No. 8,739,840 describes a drink dispensing system which has the ability to mix multiple soft drinks together manually. Other systems mix together alcoholic drinks. Typically, the beverages to be mixed are stored "upside down" and gravity pushes the beverages out of their beverage holders. Other systems use water pumps to push the beverages out of their holders.

The website http://deeplocal.com/mocktailmixer/ describes a do-it-yourself home bartender to mix "mocktails". It uses gravity and peristaltic pumps to push out the desired amount of liquid.

SUMMARY OF THE PRESENT INVENTION

There is therefore provided, in accordance with a preferred embodiment of the present invention, a machine for mixing and dispensing beverages. The machine includes a single manifold, a bottle restraining unit and a randomizing beverage activator. The manifold is connectable to a plurality of separate, pre-filled beverage holders of already prepared beverages, and provides pre-defined portions of selected the beverages to a dispensing outlet. The bottle restraining unit restrains the pre-filled bottles, which are either plastic bottles or glass bottles. The activator dispenses at least two beverages from the set of the beverage holders by randomizing an attribute of a drink, which is either an amount of the beverages or the beverage holders.

Moreover, in accordance with a preferred embodiment of the present invention, the manifold includes an air manifold, a plurality of beverage conduits, and an air pump. The air manifold connects to the set of beverage holders and includes an air conduit per beverage holder. There is one beverage conduits per beverage holder and each is connected to an outlet of the beverage holder. The air pump connects to the air manifold to pump air through activated ones of the air conduits and into the associated upright beverage holders to lift the associated beverage out of the associated the beverage conduit.

Furthermore, in accordance with a preferred embodiment of the present invention, the activator includes a plurality of solenoids, one per beverage, a pseudo-random number generator to provide randomizing information about a mixed beverage to be dispensed and an activator to activate the solenoids according to the randomizing information.

Further, in accordance with a preferred embodiment of the present invention, the randomizing information is a dispensing ratio for beverages and the machine also includes a dispensing time converter to convert the dispensing ratio to a dispensing time per beverage holder, wherein the ratio defines the number of time segments each beverage holder is activated.

Additionally, in accordance with a preferred embodiment of the present invention, the solenoids are in-line with the air manifold. Alternatively, in accordance with a preferred embodiment of the present invention, the solenoids are in line with the beverage conduits.

Furthermore, in accordance with a preferred embodiment of the present invention, one of the beverage holders holds a cleaning liquid.

Further, in accordance with a preferred embodiment of the present invention, the manifold includes at least one quick disconnect. Moreover, at least one of the quick disconnects is connected to one of the air conduits and includes a valve therein. Further, at least one of the quick disconnects is connected to one of the beverage conduits.

Still further, in accordance with a preferred embodiment of the present invention, at least one quick disconnect forms part of a cap for one of the beverage holders.

Moreover, in accordance with a preferred embodiment of the present invention, the attribute is also chosen from: whether or not to add ice and whether or not to utilize alcoholic beverages.

Finally, in accordance with a preferred embodiment of the present invention, the machine also includes a container fluid level detection for at least one of: the beverage holders and a cup receiving the output of the activator.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIG. 2A is a schematic illustration of a random bartender system, constructed and operative in accordance with a preferred embodiment of the present invention;

Figure 1A:
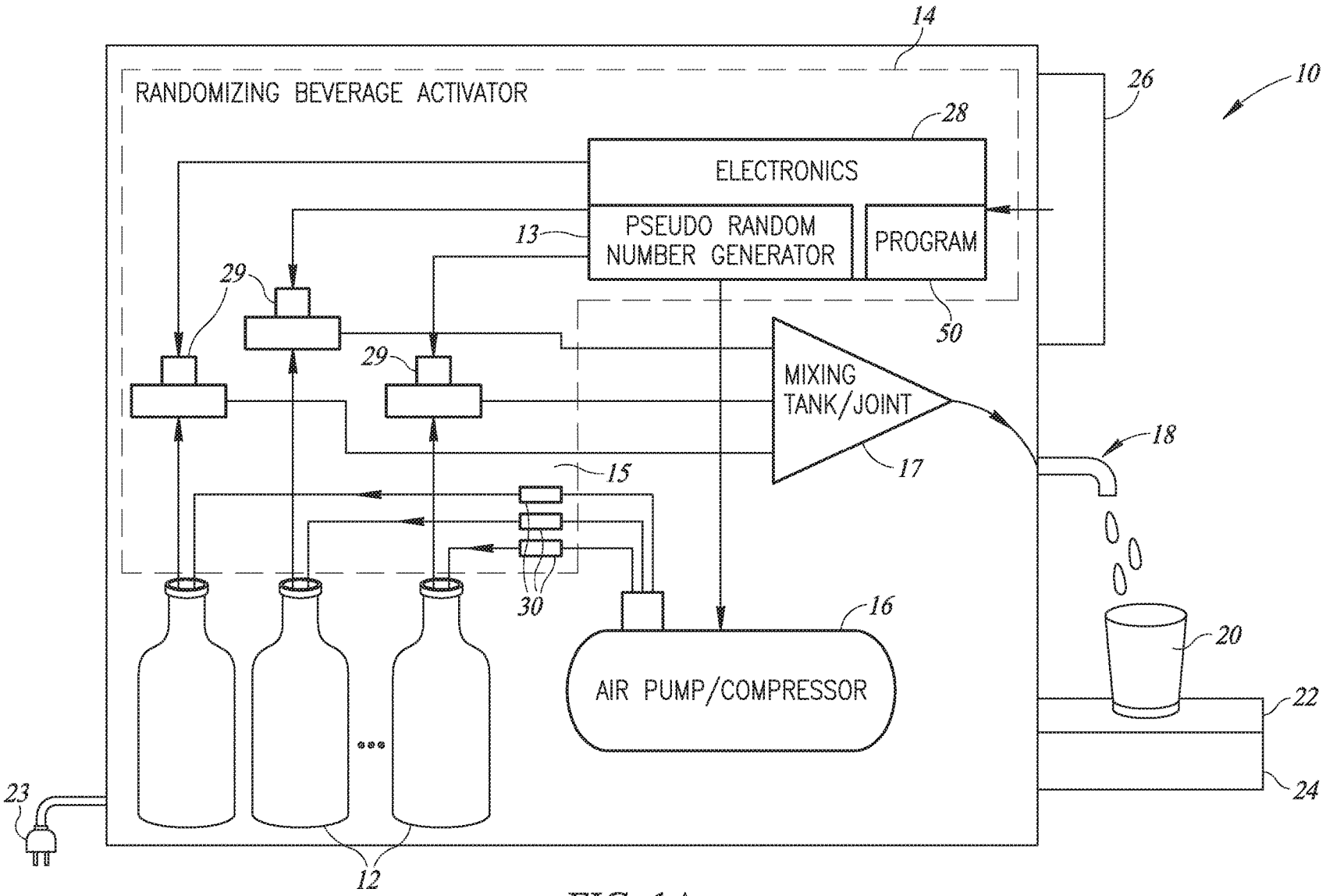
FIG. 1B is a schematic illustration of the operation of the system of FIG. 1A.
FIG. 1C is a pseudo-code illustration of the operations of a dispensing time converter, useful in the system of FIG. 1A.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Applicants have realized that parties and social events often include an element of fun and that a "random bartender" device or a "pseudo-random bartender" system, which may mix liquors and/or mixed soft drinks with random ratios to each other, may provide such an element of fun. The device of the present invention may be used as a beverage creating/mixing/dispensing machine.

Figures 1B, 1C:
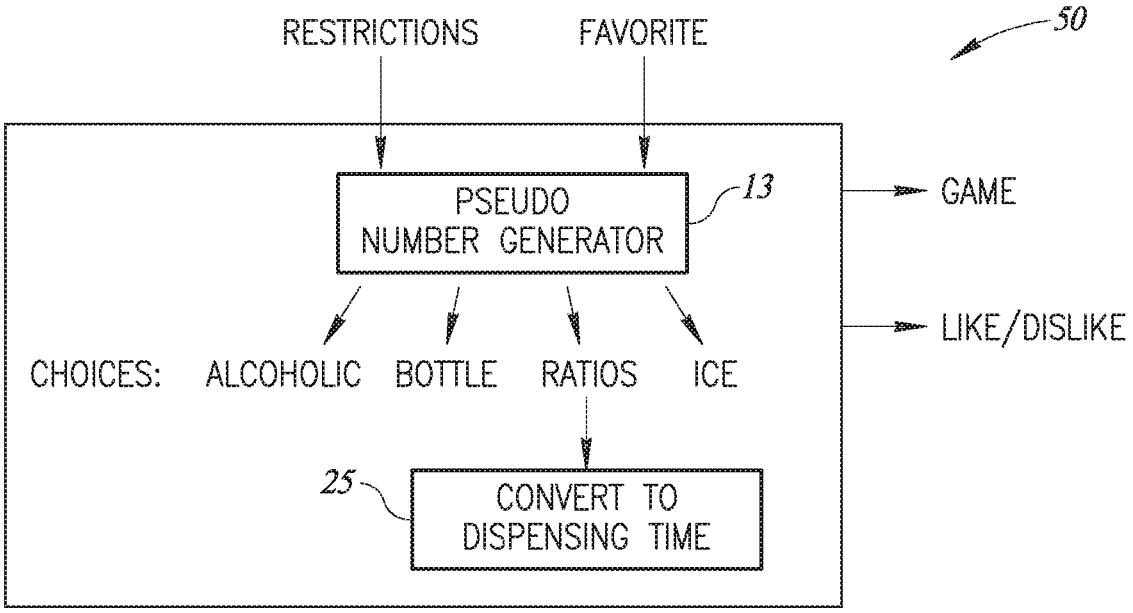

Reference is now made to FIG. 1A, which illustrates a random bartender system 10, constructed and operative in accordance with a preferred embodiment of the present invention and to FIG. 1B, which generally illustrates its operation. System 10 may comprise a randomizing beverage activator 14, a manifold 15 connecting multiple, separate, standard-size plastic or glass bottles or beverage holders 12 of beverage (alcoholic or otherwise) to activator 14, an air pump 16 to move the beverage through manifold 15 to a mixing tank 17 and from there through a dispensing spout 18 to a cup 20. Cup 20 may rest on a cup holder 22 with or without a liquid overflow catcher 24. System 10 may also comprise a user interface (UI) unit 26.

For example, the user may provide or insert or load multiple (e.g., two, or three, or five, or ten) types of beverages into the device (e.g., stored in the multiple, separate, standard-size plastic bottles 12 in which they are sold); and randomizing beverage activator 14, such as implemented with electronics 28, such as a microcontroller or chip or Integrated Circuit (IC) or other component, and solenoids 29 operating on manifold 15, may order or perform random (or pseudo-random) mixing and dispensing of two or more of the beverages together, at a pre-defined ratio and/or at a user-selected ratio and/or at a pseudo-random ratio. In some embodiments, the drinks may be forced out of bottles 12, using air pressure from a compressor 16, and may be mixed in mixing tank 17, which may, alternatively, be a long hose with multiple inlets or a secondary manifold.

A switch in the machine may switch it to operate as a regular non-random drink dispenser. In some embodiments, a user may command the machine to "save" in its memory or storage unit, for subsequent retrieval, a "favorite" mixture of beverages and their respective ratios.

In a demonstrative embodiment, the device may comprise five bottles 12; each bottle being, for example, a standard-size two-liter plastic bottle, or a standard-size 1.5-liter plastic bottle, or a standard-size 1-liter bottle, or a combination of such bottles of different types and/or volumes, each storing an already prepared beverage, such as those sold in stores.

For example, bottle 1 may store cola; bottle 2 may store orange juice; bottle 3 may store cranberry juice; bottle 4 may store lemonade; and bottle 5 may store water.

Activator 14 may operate with a pseudo-random number generator 13, to provide random values to a microcontroller unit or MCU for randomization of drinks, and/or may operate to dispense a single drink per the user's command. System 10 may include a switch or other UI element, to switch between random and non-random dispensing modes; optionally, such switching between modes may be activated via a program, a touch-screen, a button, an "app" or a mobile application, or the like.

As shown in FIG. 1B, randomizing beverage activator 14 may comprise a software program 50 which may operate pseudo-random number generator 13 to select choices from among a plurality of choice types. For example, number generator 13 may establish which drink(s) to dispense, the quantity of liquid to dispense, and in the case of multiple liquids being selected, the ratio between or among the randomly-selected liquids.

In a first example, the user may press or engage user interface (UI) element 26, such as a button or a touch-screen or a physical button, and the device may select a pseudo-random number of multiple bottles (e.g., 2 or 3 or 4 or 5 bottles); and may automatically prepare a mixture of their respective beverages, at a pre-defined non-random ratio. For example, the device may randomly select the bottles numbers 2 and 4 and 5 and may extract from them beverages at a ratio of 1:1:1 (equal parts), or at a ratio of 1:2:1 (namely, one part bottle 2, two parts bottle 4, and one part bottle 5), which are mixed together and dispensed.

In a second example, the user may press or engage UI element 26 to indicate to activator 14 which beverages to mix (e.g., the user indicates to mix bottles numbers 1, 3 and 4); and activator 14 may determine pseudo-randomly at which ratio to mix them (e.g., at a ratio of 1:2:3 parts, or at a ratio of 2:1:2 parts, or the like).

In a third example, the user may press or engage UI element 26 corresponding to "fully random operation" or to a "Surprise Me!" function, causing activator 14 to operate entirely randomly, such that the device (and not the user) may autonomously determine, pseudo-randomly: (i) how many of the beverage bottles to mix together, (ii) which ones of the beverage bottles to mix together, and (iii) and what ratio to mix them; thereby dispensing a fully random mixture.

In a fourth example, the user may configure or define, that at least one of the bottles 12 contains a particular beverage that can be mixed only within a pre-defined range of values, or only below a threshold maximum value or ratio, or only above a threshold minimum value or ratio, or only within other pre-defined conditions. For example, the user may utilize user interface 26 to indicate to activator 14 that bottle 2 contains vodka, or other alcoholic beverage; and that if bottle 2 is randomly selected, then no other alcoholic beverage is allowed to be selected together with it at the same mixture; or, that if bottle 2 is randomly selected, then the contents of bottle 2 (vodka) would be no more than K percent (e.g., no more than 5 percent) of the final mixture. In another example, the user may indicate that bottle 3 contains cranberry juice, and that if bottle 3 is randomly selected, then activator 13 must dispense the liquid of bottle 3 to be in the range of M percent to N percent of the final mixture (e.g., in the range of 15 to 28 percent of the final mixture). Other suitable conditions or ranges or ratios may be indicated or defined by the user.

In some embodiments, and in any of the above examples, the user may further indicate to activator 14 (e.g., after the beverage mixture is dispensed), that the user likes or "favorites" the particular random or semi-random mixture; and in response to such indication, activator 14 may register or store the "random recipe" that yielded the user-approved mixture, enabling the user to subsequently retrieve and re-do that exact same mixture on-demand.

For example, activator 14 may temporarily store, in a memory unit or a storage unit, that it has just dispensed a mixture of bottle 1, bottle 4 and bottle 5, at a ratio of 2:1:5 among them. The user may then consume or taste the dispensed beverage and may indicate to activator 14 that the user "likes" this particular mixture and wishes activator 14 to "save" it as "preferred mixture number 1". Subsequently, the user may later command activator 14 to prepare "preferred mixture number 1"; and activator 14 may retrieve from its memory unit or storage unit the particular combination of bottles and their respective ratio and may proceed to automatically prepare the pre-stored beverage mixture. In some embodiments, activator 14 may have "favorite" slots (e.g., ten slots) that the user may configure to correspond to his "favorite" mixtures; and may further label them or title them accordingly.

Conversely, in some embodiments, and in any of the above examples, the user may further indicate to activator 14 (e.g., after the beverage mixture is dispensed), that the user "dislikes" the particular random or semi-random mixture; and in response to such indication, activator 14 may register or store in a "black-list", the "random recipe" that yielded the user-disapproved mixture, thereby causing activator 14 to avoid or skip such combination in the future.

For example, the user may indicate to activator 14 that the user "disliked" a recent, random, mixture of bottle 1 with bottle 3 and bottle 5, at a ratio of 2:2:7 parts among them; and activator 14 may "blacklist" this particular combination at this particular ratio, and may ensure that subsequent iterations do not yield this result, or may "skip" or "discard" this particular combination if it is randomly selected.

In another implementation, activator 14 may firstly determine randomly whether to dispense an alcoholic drink or a non-alcoholic drink; and then, may proceed to dispense a mixture that necessarily complies with the randomly-selected type of beverage. In another implementation, the system may be able to pre-indicate to the user whether the user desires to receive: (I) a random yet necessarily alcoholic mixture; or, (II) a random yet necessarily non-alcoholic mixture; or (III) either alcoholic or non-alcoholic random mixture.

In some embodiments, the addition of ice or ice cubes may be another factor for randomization. For example, the user may be able to pre-indicate to activator 14 whether the user desires to receive: (I) a random mixture of beverages that is ice-free; (II) a random mixture of beverages that necessarily also includes ice cubes; or (III) a random mixture of beverages in which activator 14 may randomly decide whether to add ice cubes or not to add ice cubes.

In some embodiments, activator 14 may be used for recreational purposes as part of a Guessing Game or a party game. For example, a host may configure the system and may provide information, such as, that bottle 1 contains cranberry juice, that bottle 2 contains vodka, and so forth; and activator 14 may proceed to prepare and dispense a randomized selection of some of the liquids at a random ratio among them. Then, activator 14 may ask the user(s) to guess which ingredients were used and/or at which ratios; and one or more users may input their guesses (e.g., via the interface of the system; via a website or web-page or "app" or application, or the like). In some embodiments, a reward or prize may be provided to a declared "winner" who guessed correctly the mixed ingredients and/or their ratio, or to the user whose guess was the closest to the actual mixture.

Pseudo-random number generator 13 may implement any suitable random number algorithm, such as the Fisher-Yates algorithm or any of its modified versions.

As shown in FIG. 1B, activator 14 may also comprise a dispensing time converter 25 which may convert a set of ratios, say 4:3:1, to dispensing times per bottle 12. In accordance with a preferred embodiment of the present invention, activator 14 may dispense beverage from all of the bottles at the start and may stop dispensing those beverages with the least amounts first.

An example of this is shown in FIG. 1C, to which reference is now briefly made. Activator 14 may have a fixed dispensing time, such as 10 seconds, or it may determine a dispensing time D based on the size of cup 20. In step 1, activator 14 may receive the ratios from pseudo-random number generator 13. In step 2, activator 14 may determine a maximum value M in the ratios (in the example, M=4). In step 3, activator 14 may determine a segment length S by dividing dispensing time D by maximum value M (in the example, S=M/D=10/4=2.5). In step 4, activator 14 may begin dispensing all of the selected beverages and at the end of every segment S, may determine if to close off one of the beverages. In the example, at the start, all 3 beverages are open. At time=S=2.5 sec, the beverage with ratio value 1 may be closed. At time S=7.5 sec, the beverage with value 3 may be closed and at time S=10 sec, the beverage with value 4 may be closed. It will be appreciated that the ratio defines the number of time segments each beverage holder is activated.

System 10 may include or may utilize a power source 23, for example, AC power, DC power, from mains, secondary or standby power source; from a battery, a rechargeable battery, a solar panel, a light-responsive panel, or the like.

Figure 2:
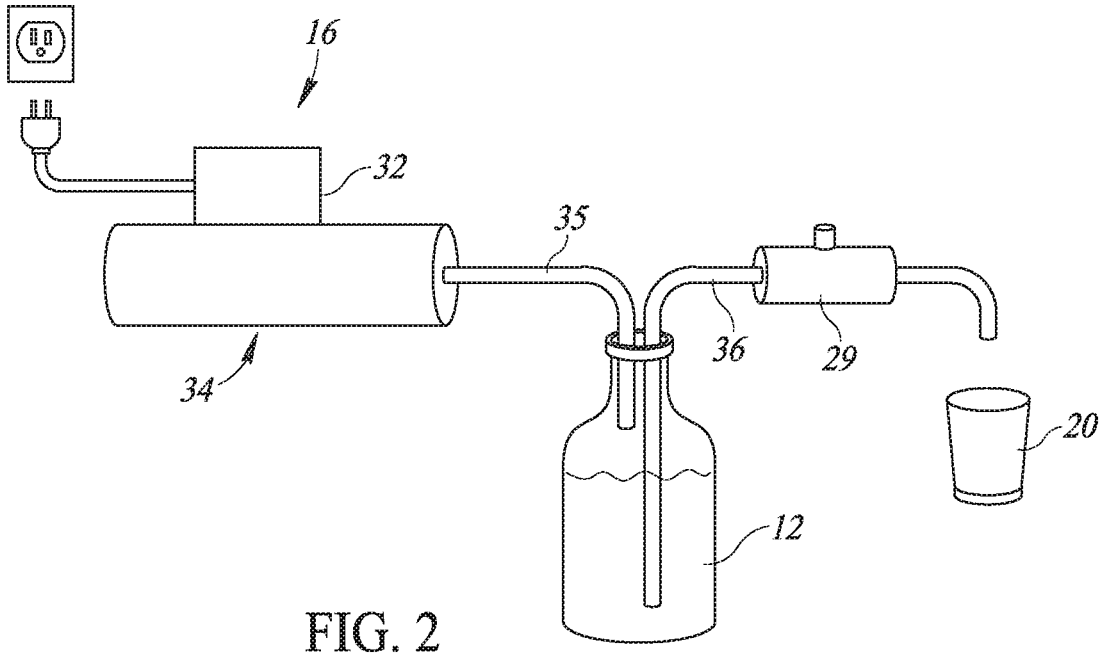
FIG. 2 is a schematic illustration of the flow of air and liquid for one bottle.

Reference is now made to FIG. 2, which illustrates the flow of air and liquid for one bottle. As shown, air pump 16 may be an air compressor 32, operating with an air tank 34, or a water pump and may be utilized to extract the liquid from each bottle. Air pump 16 may be connected to manifold 15 which may use two hoses or two pipes or two tubes (e.g., flexible tubes) per bottle 12, with one tube 35 pushing air into the bottle 12 to lift liquid out of the second tube 36. The continued flow of liquid out of bottle 12 may be controlled by solenoid 29 and may be enabled for as long as solenoid 29 is activated.

Manifold 15 may have valves 30 on each of the tubes connecting air pump 16 to bottles/beverage holders 12. Valves 30 may be used to adjust the flow exiting the manifold so that, for any given period of time, each bottle 12 may output generally the same amount of liquid. Thus, activator 14 may utilize segment lengths S to implement the desired ratios.

Valves 30 may also be check valves to prevent mixed fluids from back-flowing from mixing tank 17.

Optionally, a gravity feed mechanism and/or an injected air mechanism may be used, to prevent a vacuum from forming within a beverage bottle 12.

As described hereinbelow, special caps or covers may be used, to fit on different types of bottles. Optionally, reservoirs may be used to allow users to place drink mixes or drinks for which caps do not readily exist. Manifold 15 may distribute air pressure across the different bottles 12 and solenoids 29, which may be liquid or air solenoids, may be utilized to prevent fluids from being shot out when activator 14 is not dispensing.

The device may support an "auto fill" function, which dispenses a pre-defined amount of beverage (e.g., 12 or 16 ounces); and/or a "press to dispense" button or function, in which the mixed beverages are dispensed as long as (or, while) the user presses the dispensing button or lever or other mechanical switch or element of UI 26.

A voltage regulator may be used convert power to proper voltage and wattage.

Figure 3:
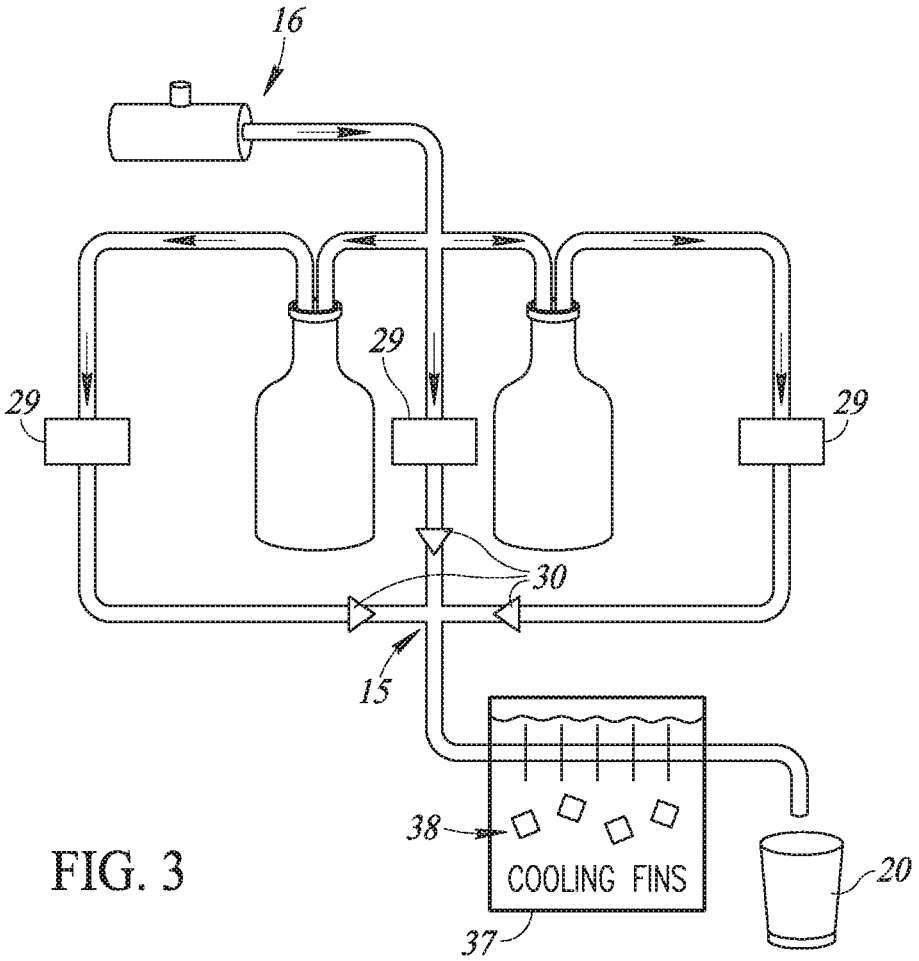
FIG. 3 is a schematic illustration of an embodiment of the system of FIG. 1A with a refrigeration unit.

Optionally and as shown in FIG. 3 to which reference is now briefly made, a refrigeration unit 37 may be used, as well as a thermal electric converter, or ice cubes 38 for cooling. Optionally, an electric heater or thermal electric converter may be used to generate heat. In some embodiments, a heat exchanger may be utilized for rapid cooling/heating. This may ensure that the mixed drinks are provided at the desired temperature.

Figure 4:
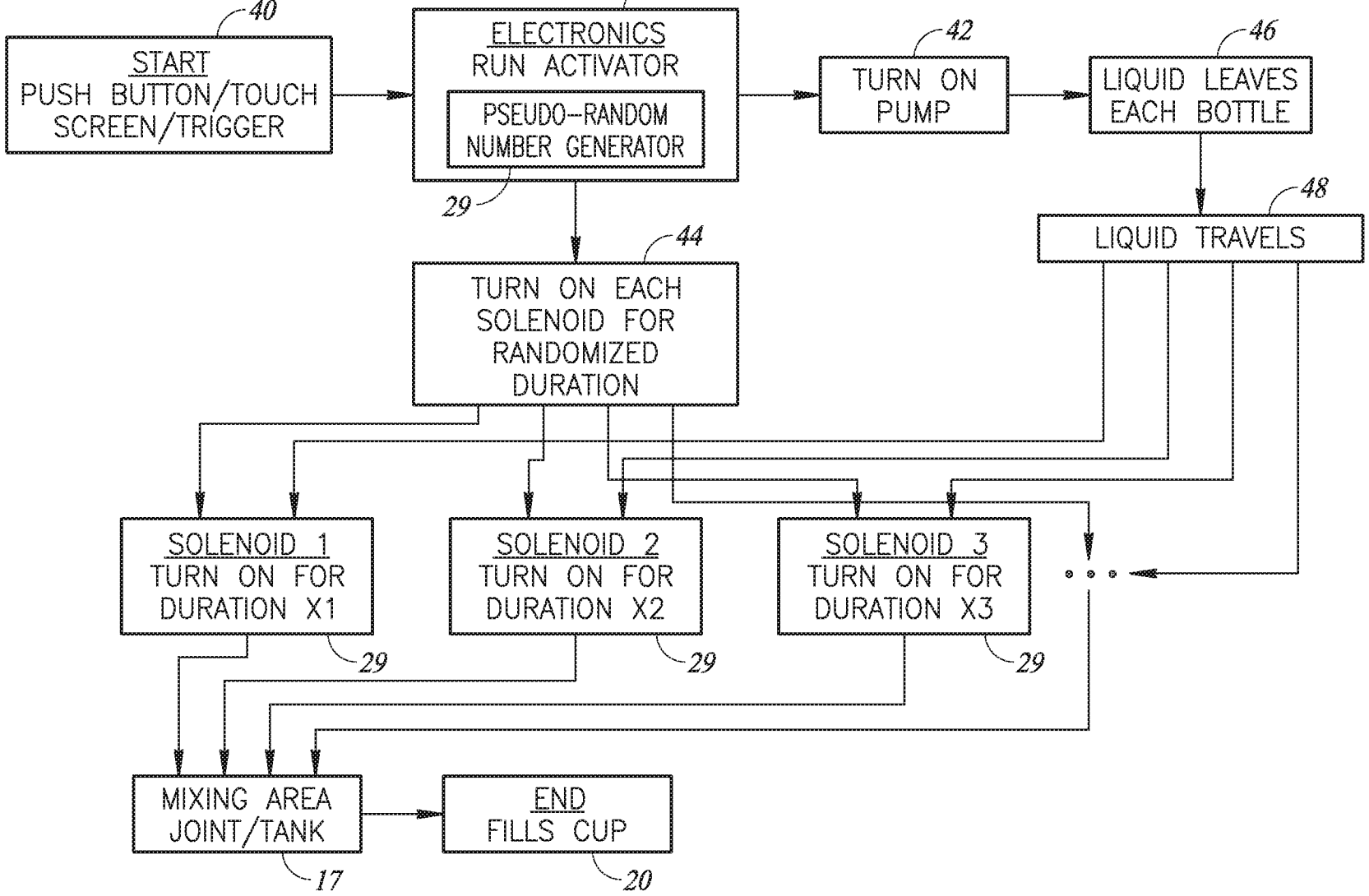
FIG. 4 is a flow chart illustration of the general operation of the system of FIG. 1A.

Reference is now made to FIG. 4, which illustrates a general operational flow chart. At step 40, system 10 may begin in response to the user's instructions on UI 26. UI 26 may provide the user's instructions to electronics 28 which may both turn on (step 42) air pump 16 and may turn (step 44) on each solenoid 29 for a randomized duration, as a function of the output of pseudo-random number generator 13. With the varied activation of solenoids 29, each turned on for a duration $X_i$, where i refers to the solenoid number and X may be a multiple of segment S, various amounts of liquid from bottles 12 may travel (steps 46 and 48) through the relevant tubes of manifold 15 into mixing area 17 and the mixed drink may then be dispensed to cup 20.

Some embodiments may utilize multiple buttons (or UI elements) that are pressed in order to mix and/or dispense multiple drinks.

As mentioned, program 50, stored in activator 14, may be used for memorizing or storing which combinations and ratios worked and people enjoyed and "liked"; and an "app" or other interface may allow users to specify which drinks they liked.

A housing may enclose or store all the equipment or units of the device, or at least some of them or part of them. Activator 14 may comprise an alcoholic-beverage controller program may be used to limit the amount of alcohol mixed into a drink, in accordance with a pre-programmed or hard-coded limit, or in accordance with a user-defined limit (e.g., parent-defined, teacher-defined, or the like).

The system may utilize a method for memorizing or storing which drink combinations did not work (were disliked) and which ratios were disliked, so as not to repeat them in subsequent iterations. Optionally, smartphones, tablets, smart-watches, and/or other gear may be connected to the drink machine for a higher level of interaction.

Figure 5A:
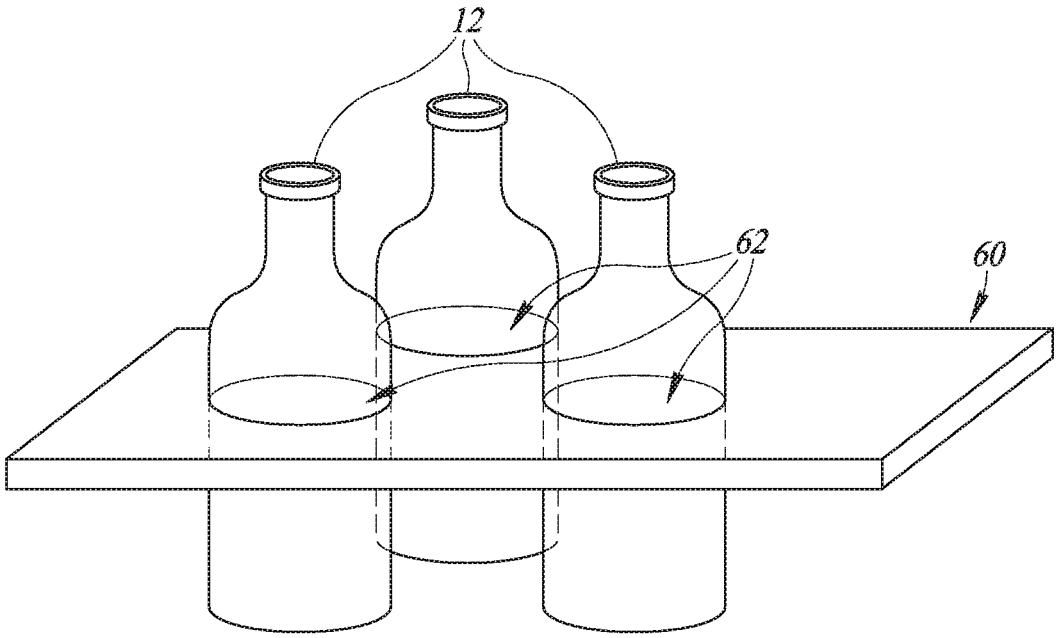
FIGS. 5A, 5B and 5C are schematic illustrations of a bottle restraining system in schematic, top and side views, respectively, useful in the system of FIG. 1A.
Figure 5B:
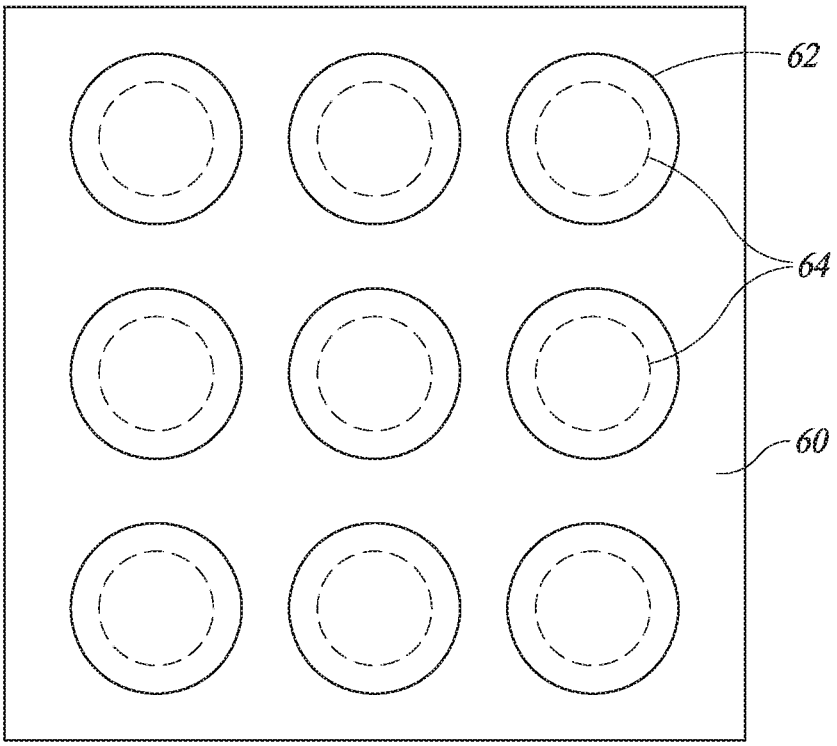

The system may utilize easy bottle removal and replacement, for fast and easy spill-free usage and operation. A bottle restraining system, such as is shown in FIGS. 5A and 5B, may be used to hold bottles upright and to prevent bottles from tipping over and/or spilling inside the machine. FIG. 5A shows a bottle restraining plate 60 with a plurality of bottle slots 62 and a plurality of bottles 12 therein. FIG. 5*b* shows bottle restraining plate 60 in a top view and shows an adjustable bottle size restrainer 64, such as a rubber baffle or adjustable metal plates, which may operate like a chuck, in bottle slots 62, so that bottles of different shapes and sizes can be properly restrained.

The restraining system may also be used to make loading and unloading bottles/containers easier due to the need to screw on a cap. The holder may keep the bottle/container stationary so that all the user needs to do is place the cap on top of the bottle and twist the bottle to lock the cap.

Figure 5C:
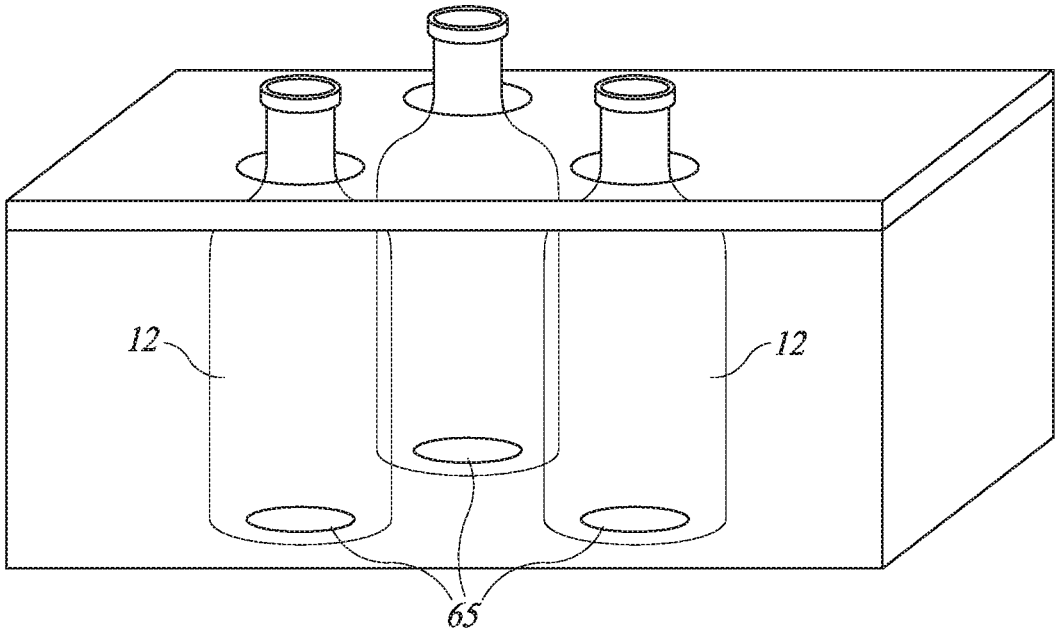
Figure 5D:
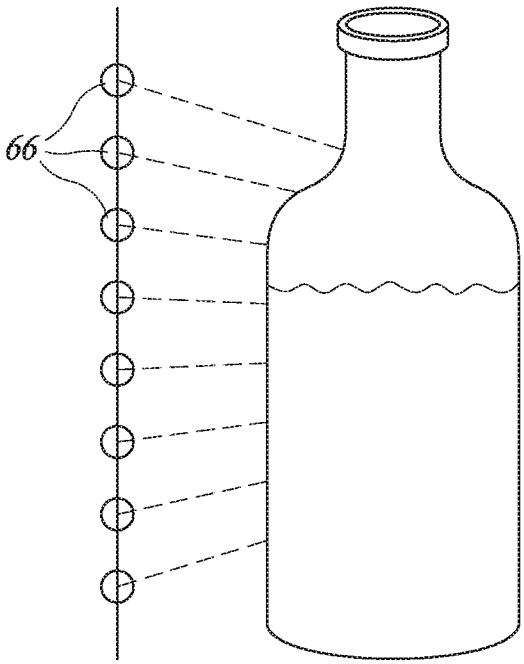
FIGS. 5D and 5E are schematic illustrations of alternative container fluid level detection systems, useful in the system of FIG. 1A.
Figure 5E:
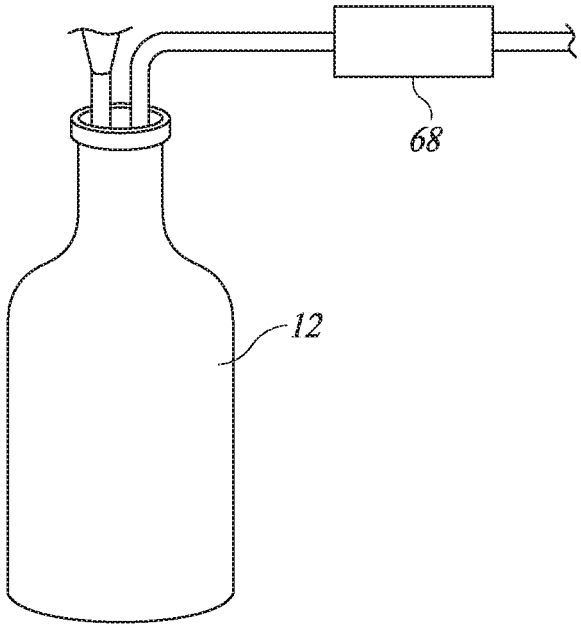

Optionally and as shown in FIG. 5C, to which reference is now briefly made, a weight sensor 64, upon which each bottle 12 may sit, may be used to may recognize when a bottle 12 or other drink holder is getting low and needs refilling. Other container fluid level detection systems may be utilized, such as a wall of sensors 66 sensing the presence of absence of fluid in a bottle 12, shown in FIG. 5D to which reference is now briefly made, or a per bottle, fluid flow sensor 68 from which the amount of beverage which has been dispensed may be determined.

Barcode scanning associated with the location of the bottle may be used for detecting which drinks are in which liquid dispenser port and/or are connected to which solenoid 29. This information may be saved in the memory of activator 14.

Figure 6:
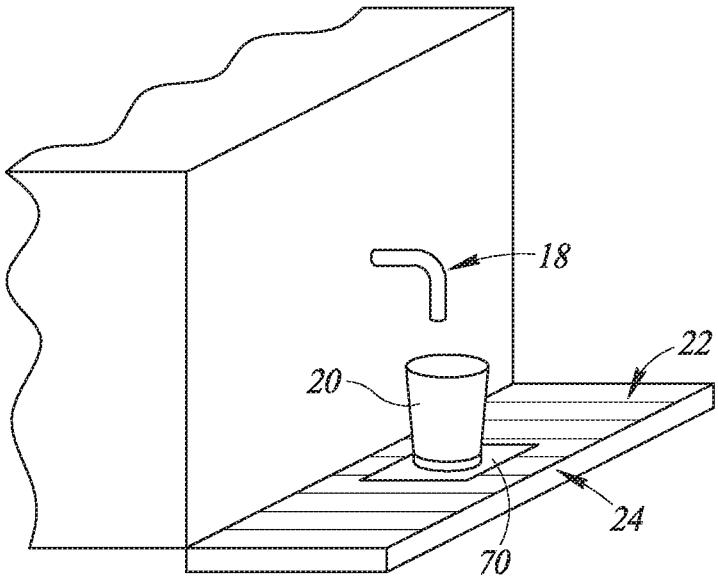
FIG. 6 is a schematic illustration of a liquid catch tray and cup weight measurement, useful in the system of FIG. 1A.

Liquid catch tray 24, shown in more detail in FIG. 6 to which reference is now made, may be used to prevent liquids from spilling on floor during dispensing. Cup holder 22 may be formed of a grill plate and may also include a pressure plate 70 to measure the weight of cup 20. The cup weight may be provided to program 50 and may be used to determine when cup 20 is full or empty.

An automatic or manual cleaning system may operate, optionally being connected to water and soap, for autonomous cleaning of the device or its parts.

In some embodiments, a drink dispensing machine comprises bottles or other reservoirs of liquids to be dispensed; containers to hold the liquids; a unit for extracting liquids from containers; tubing or other transfer mechanism to move liquid from holding containers to dispensing pipe; a box or housing to house the equipment.

Figure 7A:
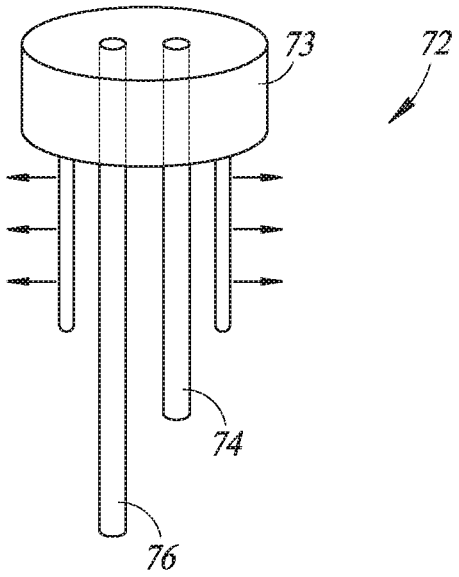
FIGS. 7A, 7B and 7C are schematic illustrations of bottle caps, useful in the system of FIG. 1A.
Figure 7B:
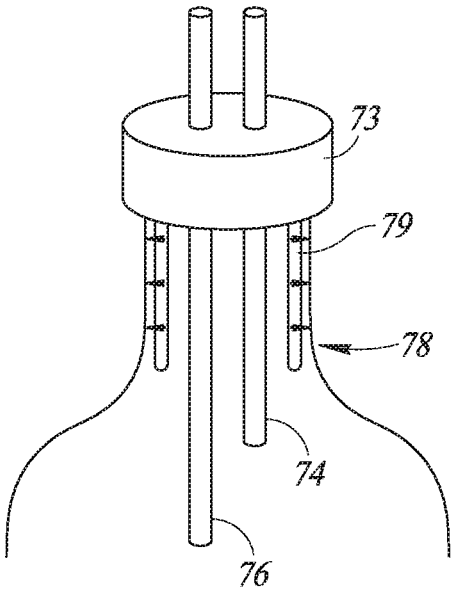

Containers can be conventional plastic bottles or glass bottles; pre-filled bottles or any other kind of bottle; or compartments or reservoirs inside the machine into which the user pours desired liquids to be used for subsequent mixing and dispensing. Alternatively, the bottles may already contain the desired liquids and may be attached via special bottle caps 72, shown in FIGS. 7A and 7B to which reference is now made, comprising a plastic cork 73, two tubes 74 and 76, for air and liquid, respectively, which extend through plastic cork 73 and spring loaded pressure catches 78 to press against the long necks 79 of most bottles in order to hold bottle caps 72 in place. These special caps may replace the bottle seals on beverage containers such as plastic caps, corks, metal caps, or the like. Such caps may also be used on the containers or reservoirs or compartments of liquids.

Figure 7C:
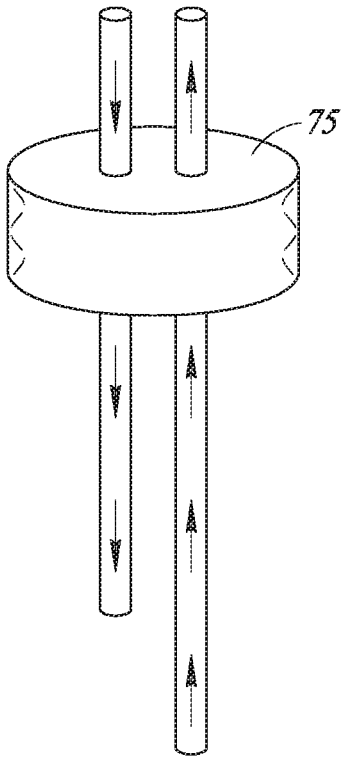

In an alternative embodiment shown in FIG. 7C to which reference is now made, special caps may be provided to replace the screw caps of bottles. These screw caps 75 may be molded with pipes 74 and 76 as part of the cap; or, two holes may be drilled into the cap and tubes 74 and 76 may be placed through the two holes in the cap.

The tubes or pipe moldings may be set so that one tube or pipe reaches the bottom of the container while the other tube or pipe stays above the level of the liquid in the bottle or container when a liquid is stored therein. As mentioned above, these pipes may operate as liquid extraction and allow air to replace the liquid that has left the bottle, to prevent a vacuum from forming within the bottle. The pipe transferring the air to the bottle may be above the liquid level in order to prevent fizzing from occurring.

The bottles may be maintained standing upright, or may be standing upside down; or in some implementations, they may be positioned sideways. The tubes may change purposes, depending on the position of the bottles. For example, if the bottle is standing upright, then the tube or pipe that reaches the bottom of the bottle acts as the liquid extraction point, and the tube above the liquid level acts as the air or gas replacement point for the liquid that has been extracted. If the bottle is upside down, then the tubes operate in a flipped manner.

Liquid may be extracted from the bottles via gravity feed, water pump, air pump, air compressor, or any other suitable form of liquid extraction.

If an air pump is used, the pump may apply pressure to the liquid inside the bottle via the first pipe which may force the liquid out of the second pipe. If the bottle is right side up, then the air pump/compressor may be attached to the shorter tube/pipe. When a button is pressed to release the drink, the air may be forced into the bottle/container, causing force to be applied to the beverage in the drink holder and forcing the beverage to go up the longer tube/pipe that is submerged in the liquid.

If the air pump/compressor is attached to the longer tube/pipe, then the bottle is upside down; and the pressure exerted by the air operates to help create a constant flow when gravity feeding is used.

If no air compressor is used, and/or if a standard water pump is used, then the water pump is self-priming or needs to be primed.

A solenoid or other air/liquid constraining device, such as a valve, may prevent the fluid from constantly flowing; and may either be manually opened or electronically opened to allow the beverage to flow from the fluid container/bottle to the dispensing port(s).

The flow constraining device may be placed either in the flow of the liquid or in the flow of the gas that replaces the liquid in the container or bottle. The flow constraining device may be mechanically opened via a cable or other form of mechanical transmission connected to a button or other UI element. The flow constraining device may also be electronically directly or indirectly connected to the button(s) or other UI elements.

Buttons (or other UI elements) may be pressed in order to facilitate the release of liquid from the liquid containing units. However, buttons (or other UI elements) may also serve other purposes, such as establishing connection to certain electronic devices and changing drink dispensing modes.

A single switch or a single button or a combination of buttons may be pressed to switch between single dispensing and random mixed dispensing mode. The switch may be a touch sensor or any other form of recognizing when a user desires a drink such as voice recognition.

In the case of single dispensing, a single liquid container is selected based on button position and wiring, and that one liquid (from that one container or bottle) is dispensed.

For example, for random button dispensing, the machine may have liquid 1, liquid 2, and liquid 3; and multiple buttons such as button 1, button 2, and button 3. In a first example, when a button is pressed, activator 14 may randomly reassign the buttons, such that, instead of button 1 dispensing liquid 1, it may dispense liquid 2. In another example, button 1 may dispense liquid 1 mixed with liquid 3 in a 4:1 ratio of liquid 1 to liquid 3. In another example, button 1 may dispense liquid 2 mixed with liquid 3, at a 5:2 ratio of liquids.

Program 50 may be used to randomly determine which ratios to use, optionally never repeating the same ratio and/or combinations twice in a row or twice within K iterations (e.g., K being 100 or 1,000 iterations). For example, pressing the first time the ratio might be 3:1:2; while pressing the second time the ratio might change to 1:4:7, or the like. The randomizing process may also be achieved using mechanical gears and/or other ratio deciding mechanisms.

In the case of an electronic system, when a button is pressed, a signal is sent to a microcontroller (MCU) or other electronic processing unit; the processing unit then decides depending on the mode, which solenoids to open and close according to single mode and random mode.

When liquid is dispensed, the pipe/tube going from the bottle/container to the outlet that dispenses the drink may have a heat exchanger for the purpose of heating or cooling the drink.

Cooling may be achieved by having the liquid(s) pass through an ice bath (as shown in FIG. 3) or other cooling medium or channel, or using refrigeration coils wrapped around the pipe to cool the liquid. Alternatively, Peltier cooling units can be used to cool the pipes. Heating is achieved in a similar manner, by using hot water as a bath or as a heating medium, instead of ice.

When using either a Peltier cooler or a refrigerator for heating or cooling, the reverse side of the process may be used to reduce power consumption and achieve space saving. For example, if a Peltier Effect cooling unit is used to cool a pipe down on one side of the Peltier cooler, then the other side of the cooler may be used to heat up a liquid instead of wasting the heat.

Due to randomization causing multiple liquids to mix, check valves 30 or other method of preventing liquids from back-flowing into the wrong liquid containers may be employed. The back-flow prevention may also be used to prevent liquids from entering the air clean out section of the dispenser. There may also be an air clean out, connected near the dispensing output, that injects air into the liquid flow after the liquids have mixed; in order to clean out the line so that the next dispense of liquid no longer has the previous mixture or its residue. The air clean out may also use a venturi injection method to add air to the stream.

The air compressor or air pump may use cylinder or tank 34 (FIG. 2) to store compressed air, so the pump is not running all the time; the air cylinder may also be used to help smooth out air flow coming from the compressor.

It will be appreciated that air manifold 15 may be used to distribute the air to the different bottles or containers and may contain control valves in order to distribute the pressure evenly across the system.

A dynamic air control manifold may be used to maintain constant flow from each bottle/container, and may adjust the amount of air injected into each bottle in order to maintain a constant and even flow at the dispensing end.

When dispensing the drink, the machine may require the user to hold down the button they have pressed until the drink has reached the level desired. Alternatively, the machine may auto recognize how large the cup is, and may auto-fill to a certain level with the user being able to override the maximum fill line by commanding the machine to stop when desired.

Figure 8:
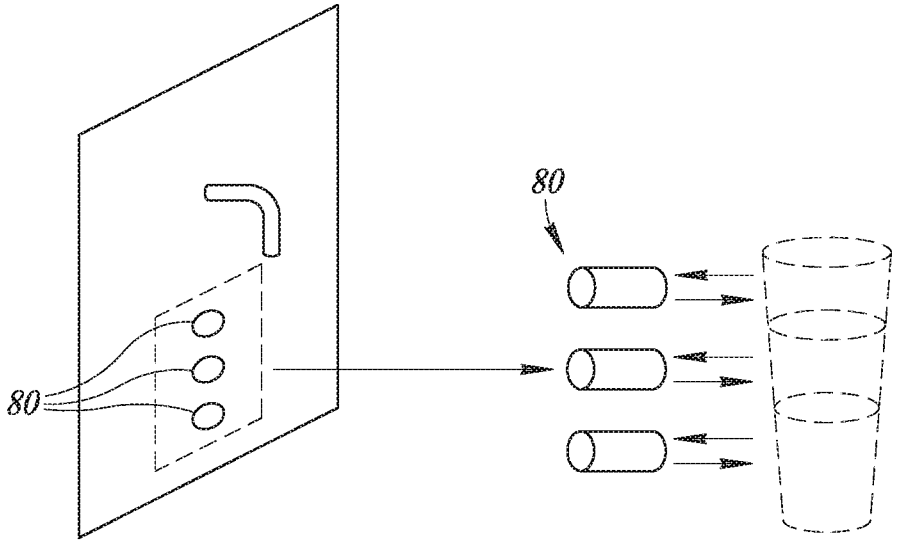
FIG. 8 is a schematic illustration of an auto-fill detection system, useful in the system of FIG. 1A.

An adjustable cup size may be used in the program, to prevent overfill of beverages. As shown in FIG. 8 to which reference is now made, the auto-fill may be achieved using sensors 80 at different heights to detect the dimensions of the cup. For example, sensors 80 may be ultrasound transceivers and the height of the cup may be determined by which sensors 80 receive a return signal from the cup and which don't.

Alternatively, the auto-fill capability may use a fill line trip sensor, a weighing scale to detect cup weight and figuring out the height of the liquid based on the weight and the size of the cup, an imager with image recognition or computer vision algorithm (e.g., capturing an image of the cup and recognizing that it has a written label of "12 oz"), or other methods for auto detecting cup size and/or fill line.

A tray or other liquid catching mechanism may be employed, to prevent liquids from falling on the floor when an overflow occurs; or the catch may be used to dispose of extra liquids.

Sensors 80 may be used to prevent the machine from dispensing a drink when no cup or liquid holding container is detected at the dispensing end of the machine.

An ice maker may be installed in the machine, to provide ice to the users with their drinks. The machine may also have an ice box which the operator may prefill with ice and the machine may dispense the ice when required to. In some embodiments, activator 14 may further determine, randomly or pseudo-randomly, (I) whether or not to add ice or ice-cubes to the mixed drink, and/or (II) how many ice cubes to add to the mixed drink or to the drink being dispensed.

When alcohol is being used in one or more of the liquid holders, the user may command the system to limit the amount of alcohol dispensed. For example, a normal drink is poured to 8 oz., but 8 oz of liquor may be defined as excessive, so a setting may limit the amount poured to a shot. In some embodiments, the user may indicate to the system in advance, that one or more particular bottles or containers store alcohol or alcoholic beverages; and may further indicate to the system in advance the limits or the allowed ranges for mixtures that include alcohol. For example, the user may indicate to the system that bottle 2 contains alcohol; and that if bottle 2 is chosen randomly to be included in a drink, then bottle 2 may provide no more than K percent (e.g., not more than 10 percent) of the final mixed beverage. The user may also indicate other mixing rules; for example, that if two (or more) alcoholic beverages are provided by the user, then no more than one of them may be randomly selected to be included in the mixed beverages.

The system may also have an auto detect feature, such as a barcode scanner and a database to figure out what the contents of each liquid holder in the machine are. The machine may auto recognize that certain liquid holders contain soda that can dispense 8 oz and that others contain alcoholic beverages, and may limit the dispensed amounts based on their alcoholic levels. For example, scotch would be given at a shot or two depending on owner's setting, whereas a bottle of wine would give 5 oz. In some embodiments, the machine may be an Internet of Things (IoT) device able to connect to the Internet and/or to a remote server or to a "cloud computing" database, in order to download or fetch from them data about beverages stored and/or dispensed.

A special connection may be employed to allow for auto cleaning; this connection may take water from a bucket or tap water, may heat it up to the necessary level for sterilization, optionally adds or combines soap, and proceeds to clean the system thoroughly. The order of water, soap, and heating can be swapped or switched. A container inside the machine may hold the soap or the water added to the machine may already have the soap added.

The cleaning procedure may dispense out the drink pour side in order to clean and sterilize all parts that are in contact with the fluids.

Alternatively, the bottles or containers that are normally filled with liquids to be dispensed as drinks may be filled with water and soap; and the machine may be run as if it is dispensing a drink. An option in the program may be to press a certain set of buttons or an option on an app to turn on a special cleaning cycle.

The machine may have wireless capabilities that allow users to connect their phones or other electronics with wireless capabilities to the machine.

An app using the wireless capabilities of a mobile device may be used to allow users the ability to order drinks, tell the machine which drinks they enjoyed, and what combination of drinks (such as in the case of coke freestyle) they would like mixed together for their order.

The ability to tell the machine which drinks the user enjoyed allows the machine to remember which beverage holders and what ratios worked for an individual or group.

The system may allow a user to request a drink they previously enjoyed, even though the machine would normally forget what it gave them and give them a new combination.

The system may reproduce a previous mixture as long as liquid holders always contain the same liquids; however, if new liquids are put in those holding positions or if the liquids are moved to different spot, then the system may utilize a barcode or other label to find the right bottles and to recreate the desired mixture, using other position memorizing system. This way if a liquid moves to a different position, it can still be accessed instead of the liquid in the original position; and if the liquid does not exist in the system then the system returns an indication that the drink is unavailable at this time.

The app may include the ability to set the desired ratios of different drinks, how much of each drink to pour (assuming it does not exceed drink dispensing limitations set by the owner such as alcohol limitations).

If refrigeration of the bottles or containers is used instead of refrigeration just before dispensing, then the app can allow the owner to set a start time for cooling to begin. This may also be used in the case of heating certain liquids. The owner can decide which containers need to be cooled and which ones need to be heated.

The cap for the bottles or containers may contain a locking mechanism in the cap that prevents spillage when the bottle/container is not connected to the machines pipes. The cap has a valve that seals when the cap is not connected to the machine, thus allowing the user to switch out bottles without worrying about spillage.

The electronic controller may turn the solenoids or flow control valves on and off using pulse width modulation to reduce power consumption. Pulse width modulation turns the power on and off at a high frequency and different on off periods to achieve a lower voltage than is supplied. This lowering of the voltage is enough to turn the control valve on, but does not waste energy in the form of heat due to the minimal amount of power being used to keep the device on.

The system may attempt to fool a user who requests a previously liked drink mix. For example, the user liked bottle 1, bottle 2, and bottle 4 in a ratio of 4:2:5 and told the machine to save the drink as a liked drink. When the user then requests the same drink; the machine may use the same bottles, but instead of a 4:2:5 ratio, it may change the ratios to 6:3.5:1.

Figure 9A:
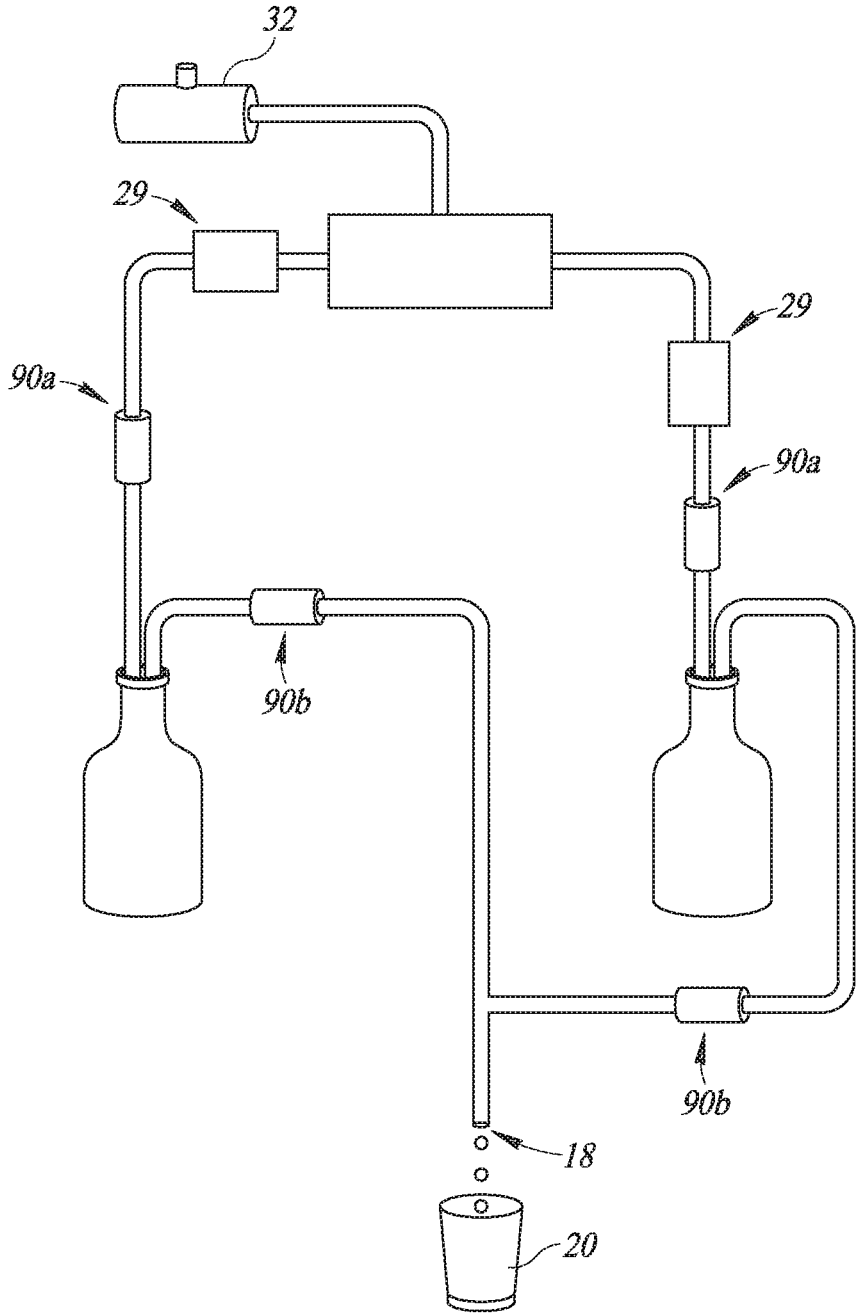
FIGS. 9A and 9B are schematic illustrations of the system of FIG. 1A with quick disconnects.
Figure 9B:
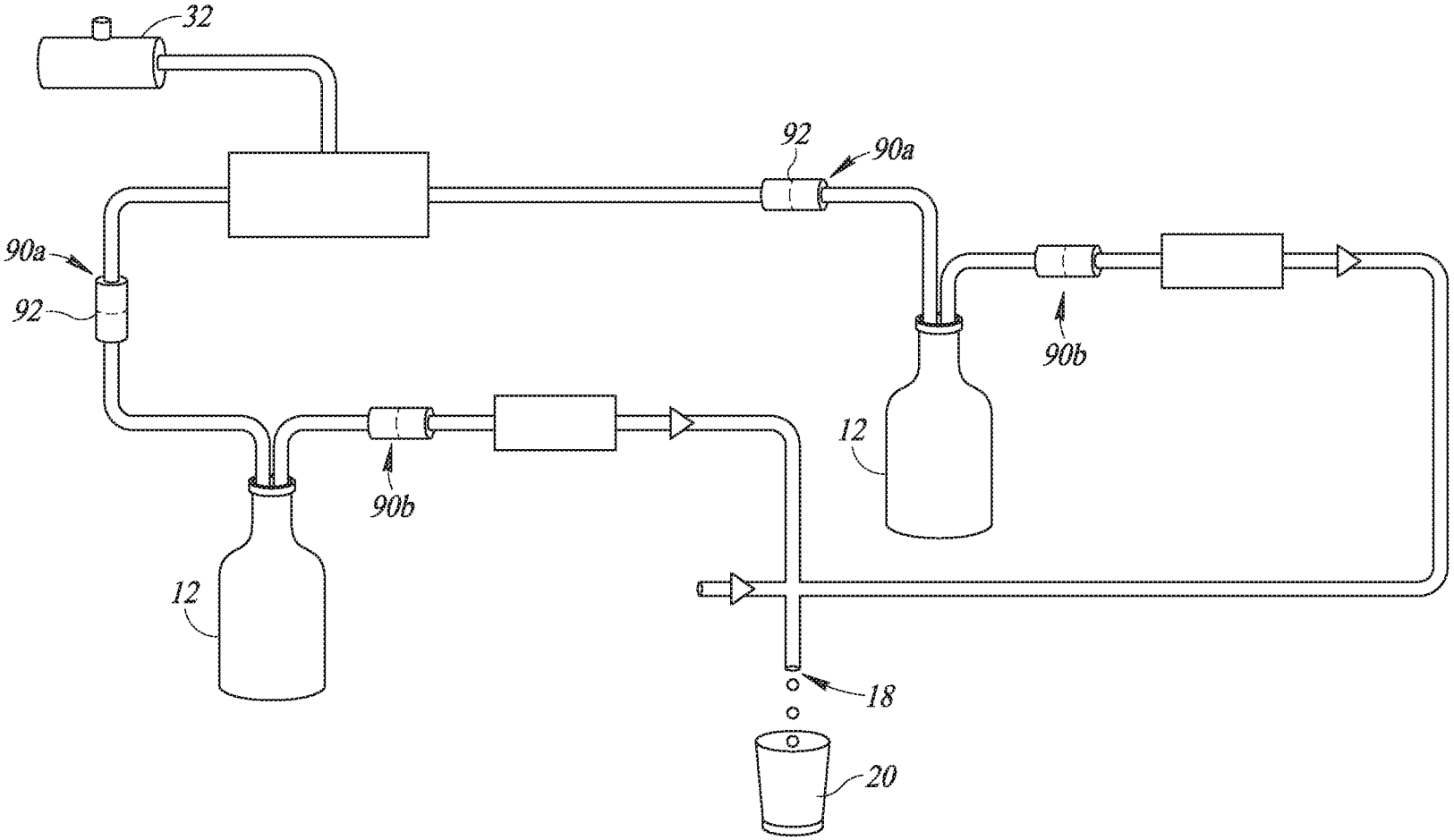

In some embodiments, the machine may have tubing that goes directly to and from the liquid holders to the intake and outlet and in other embodiments, such as those shown in FIGS. 9A and 9B to which reference is now made, there may be quick disconnects 90*a* and 90*b*, such as the APC series of couplings, commercially available from US Plastics, between the air intake and the liquid outlet, respectively, to allow for easy changing of beverages. Quick disconnects 90*a* may also have a valve 92 inside, as shown in FIG. 9B, that may prevent fluids from escaping into the air manifold when the quick disconnect is open.

In some embodiments and as shown in FIG. 9A, solenoids 29 may be connected on the air intake side in order to depressurize bottles that are empty.

Figure 10A:
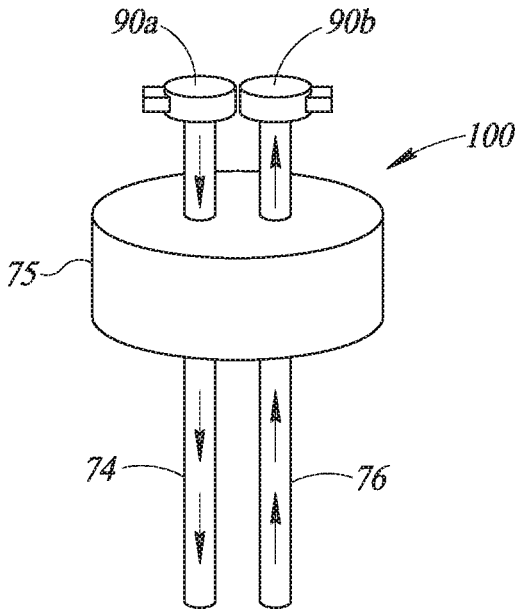
FIGS. 10A and 10B are schematic illustrations of alternative bottle caps with connectors, useful in the system of FIG. 1A.
Figure 10B:
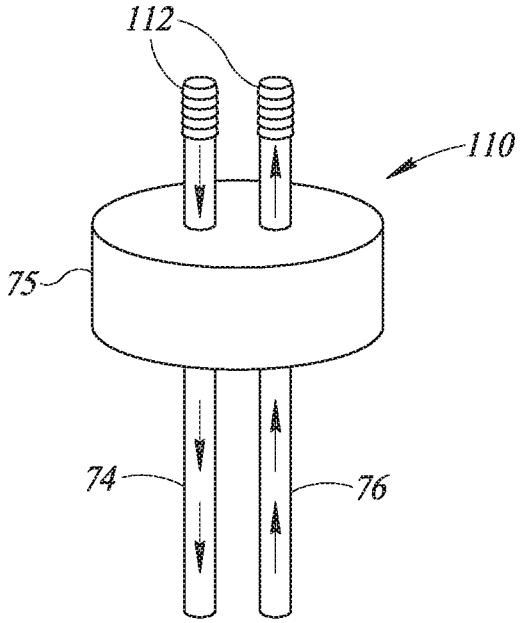

Reference is now briefly made to FIGS. 10A and 10B, which illustrate two alternative caps 100 and 110, respectively. Caps 100 and 110 each may comprise screw cap 75 with tubes 74 and 76 molded as part of the cap. In accordance with a preferred embodiment of the present invention, cap 100 may also comprise quick disconnects 90*a* and 90*b* connected to or molded with screw cap 75. Typically, disconnect 90*a* may be connected to the air input side while disconnect 90*b* may be connected with the liquid outlet side. Cap 100 may make connecting and disconnecting bottles 12 much simpler.

In accordance with a preferred embodiment of the present invention, cap 110 may also comprise barbed connectors 112 connected to or molded with screw cap 75 onto which the tubes of manifold 15 may be pushed for a tight connection.

Unless specifically stated otherwise, as apparent from the preceding discussions, it is appreciated that, throughout the specification, discussions utilizing terms such as "processing," "computing," "calculating," "determining," or the like, refer to the action and/or processes of a general purpose computer of any type such as a client/server system, mobile computing devices, smart appliances or similar electronic computing device that manipulates and/or transforms data represented as physical, such as electronic, quantities within the computing system's registers and/or memories into other data similarly represented as physical quantities within the computing system's memories, registers or other such information storage, transmission or display devices.

Embodiments of the present invention may include apparatus for performing the operations herein. This apparatus may be specially constructed for the desired purposes, or it may comprise a general-purpose computer selectively activated or reconfigured by a computer program stored in the computer. The resultant apparatus when instructed by software may turn the general-purpose computer into inventive elements as discussed herein. The instructions may define the inventive device in operation with the computer platform for which it is desired. Such a computer program may be stored in a computer readable storage medium, such as, but not limited to, any type of disk, including optical disks, magnetic-optical disks, read-only memories (ROMs), volatile and non-volatile memories, random access memories (RAMs), electrically programmable read-only memories (EPROMs), electrically erasable and programmable read only memories (EEPROMs), magnetic or optical cards, Flash memory, disk-on-key or any other type of media suitable for storing electronic instructions and capable of being coupled to a computer system bus.

The processes and displays presented herein are not inherently related to any particular computer or other apparatus. Various general-purpose systems may be used with programs in accordance with the teachings herein, or it may prove convenient to construct a more specialized apparatus to perform the desired method. The desired structure for a variety of these systems will appear from the description below. In addition, embodiments of the present invention are not described with reference to any particular programming language. It will be appreciated that a variety of programming languages may be used to implement the teachings of the invention as described herein.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A machine for mixing and dispensing beverages, the machine comprising:

a single manifold connectable to a plurality of separate, pre-filled beverage holders of already prepared beverages, said manifold to provide pre-defined portions of selected said beverages to a dispensing outlet;

a bottle restraining unit to restrain said pre-filled beverage holders, wherein said pre-filled beverage holders are at least one of: plastic bottles and glass bottles; and a randomizing beverage activator to dispense at least two beverages from said beverage holders by randomizing an attribute of a drink, wherein said attribute is chosen from: an amount of said beverages and said beverage holders, wherein said manifold comprises;

an air manifold to connect to said beverage holders, said air manifold comprising multiple air conduits, each air conduit associated with a different beverage holder;

a plurality of beverage conduits, one per beverage holder, each beverage conduit connected to an outlet of a different said beverage holder; and an air pump connecting to said air manifold to pump air through activated ones of said air conduits and into beverage holders associated with said activated ones of said air conduits to lift said already prepared beverages out of said beverage conduits.

2. The machine according to claim 1 wherein said randomizing beverage activator comprises:

a plurality of solenoids, one per beverage;

a pseudo-random number generator to provide randomizing information about a mixed beverage to be dispensed; and an activator to activate said solenoids according to said randomizing information.

3. The machine according to claim 2 wherein said randomizing information is a dispensing ratio for beverages and also comprising a dispensing time converter to convert said dispensing ratio to a dispensing time per beverage holder, wherein said dispensing ratio defines the number of time segments each beverage holder is activated.

4. The machine according to claim 2 wherein said solenoids are in-line with said air manifold.

5. The machine according to claim 2 wherein said solenoids are in line with said beverage conduits.

6. The machine according to claim 1 and wherein said manifold comprises at least one quick disconnect.

7. The machine according to claim 6 wherein at least one of said at least one quick disconnect is connected to one of said air conduits and comprises a valve therein and wherein at least one of said at least one quick disconnect is connected to one of said beverage conduits.

8. The machine according to claim 6 and wherein said at least one quick disconnect forms part of a cap for one of said beverage holders.

9. The machine according to claim 7 and also comprising a container fluid level detection for at least one of: said beverage holders and a cup receiving an output of said randomizing beverage activator.

* * * * *